US009850619B2

(12) United States Patent
Wells et al.

(10) Patent No.: US 9,850,619 B2
(45) Date of Patent: Dec. 26, 2017

(54) CLEANING APPARATUS AND METHOD

(71) Applicant: Xeros Limited, Rotherham (GB)

(72) Inventors: Simon Paul Wells, Rotherham (GB); Gareth Evan Lyn Jones, Bath (GB)

(73) Assignee: Xeros Limited, Rotherham (GB)

( * ) Notice: Subject to any disclaimer, the term of this patent is extended or adjusted under 35 U.S.C. 154(b) by 60 days.

(21) Appl. No.: 14/777,573

(22) PCT Filed: Mar. 18, 2014

(86) PCT No.: PCT/GB2014/050856

§ 371 (c)(1),
(2) Date: Sep. 16, 2015

(87) PCT Pub. No.: WO2014/147391

PCT Pub. Date: Sep. 25, 2014

(65) Prior Publication Data

US 2016/0251795 A1 Sep. 1, 2016

(30) Foreign Application Priority Data

Mar. 20, 2013 (GB) ..... 1305122.2

(51) Int. Cl.

| | |
|---|---|
| ***D06F 21/00*** | (2006.01) |
| ***D06F 39/08*** | (2006.01) |
| ***D06F 21/14*** | (2006.01) |
| ***D06F 58/02*** | (2006.01) |
| ***D06F 35/00*** | (2006.01) |
| ***D06F 37/04*** | (2006.01) |

(Continued)

(52) U.S. Cl.

CPC ..... *D06F 39/083* (2013.01); *D06F 21/14* (2013.01); *D06F 35/00* (2013.01); *D06F 35/006* (2013.01); *D06F 37/04* (2013.01); *D06F 39/02* (2013.01); *D06F 58/02* (2013.01); *D06F 37/065* (2013.01); *D06F 2226/00* (2013.01); *D06F 2232/00* (2013.01)

(58) Field of Classification Search

None

See application file for complete search history.

(56) References Cited

U.S. PATENT DOCUMENTS

| | | | |
|---|---|---|---|
| 5,498,115 | A | 3/1996 | Perneborn |
| 8,959,961 | B2 | 2/2015 | Jenkins et al. |

(Continued)

FOREIGN PATENT DOCUMENTS

| | | | |
|---|---|---|---|
| CN | 102061588 | A | 5/2011 |
| CN | 102061589 | A | 5/2011 |

(Continued)

OTHER PUBLICATIONS

English Machine translation of CN20-2543632.*

(Continued)

*Primary Examiner* — Michael Barr
*Assistant Examiner* — Jason Riggleman
(74) *Attorney, Agent, or Firm* — Clark & Elbing LLP

(57) ABSTRACT

The invention provides an apparatus and method for use in the treatment of substrates, whereby the apparatus comprises housing means having mounted therein a rotatably mounted drum (17), access means through which said substrates may be loaded into said drum (17), and a multiplicity of solid particulate material delivery means.

19 Claims, 6 Drawing Sheets

(51) Int. Cl.
*D06F 39/02* (2006.01)
*D06F 37/06* (2006.01)

(56) References Cited

U.S. PATENT DOCUMENTS

| | | | |
|---|---|---|---|
| 8,974,545 | B2 | 3/2015 | Burkinshaw et al. |
| 9,017,423 | B2 | 4/2015 | Burkinshaw et al. |
| 9,121,000 | B2 | 9/2015 | Burkinshaw et al. |
| 9,127,882 | B2 | 9/2015 | Jenkins et al. |
| 9,297,107 | B2 | 3/2016 | Jenkins |
| 9,315,766 | B2 | 4/2016 | He et al. |
| 9,404,210 | B2 | 8/2016 | He et al. |
| 9,410,278 | B2 | 8/2016 | He et al. |
| 9,476,155 | B2 | 10/2016 | He et al. |
| 9,487,898 | B2 | 11/2016 | He et al. |
| 9,523,169 | B2 | 12/2016 | Sawford et al. |
| 9,550,966 | B2 | 1/2017 | Burkinshaw et al. |
| 9,587,337 | B2 | 3/2017 | He et al. |
| 9,587,340 | B2 | 3/2017 | Jenkins et al. |
| 9,631,314 | B2 | 4/2017 | Yin et al. |
| 9,803,307 | B2 | 10/2017 | Jenkins et al. |
| 2008/0202435 | A1 | 8/2008 | Nowacek |
| 2009/0276966 | A1 | 11/2009 | Mette et al. |
| 2011/0296628 | A1 | 12/2011 | Jenkins et al. |
| 2012/0048299 | A1 | 3/2012 | Jenkins et al. |
| 2012/0304400 | A1* | 12/2012 | Jenkins ..... D06F 35/00 8/137 |
| 2013/0061404 | A1 | 3/2013 | Jenkins |
| 2013/0167882 | A1 | 7/2013 | Burkinshaw et al. |
| 2013/0276242 | A1 | 10/2013 | Jenkins et al. |
| 2013/0283542 | A1 | 10/2013 | Jenkins et al. |
| 2013/0340487 | A1 | 12/2013 | Yin et al. |
| 2014/0123402 | A1 | 5/2014 | He et al. |
| 2014/0201929 | A1 | 7/2014 | He et al. |
| 2014/0317860 | A1 | 10/2014 | He et al. |
| 2015/0027173 | A1 | 1/2015 | Wu et al. |
| 2015/0096128 | A1 | 4/2015 | Sawford et al. |
| 2015/0096129 | A1 | 4/2015 | Sawford et al. |
| 2015/0128358 | A1 | 5/2015 | Wells et al. |
| 2015/0148278 | A1 | 5/2015 | Burkinshaw et al. |
| 2015/0152357 | A1 | 6/2015 | Abercrombie et al. |
| 2015/0152585 | A1 | 6/2015 | Sawford et al. |
| 2015/0175945 | A1 | 6/2015 | Waddon et al. |
| 2015/0252511 | A1 | 9/2015 | Roberts et al. |
| 2015/0344824 | A1 | 12/2015 | Burkinshaw et al. |
| 2016/0032522 | A1 | 2/2016 | Steele |
| 2016/0040260 | A1 | 2/2016 | Steele |
| 2016/0122932 | A1 | 5/2016 | Wells et al. |
| 2016/0122936 | A1 | 5/2016 | Wells et al. |
| 2016/0195409 | A1 | 7/2016 | Goldberg et al. |
| 2016/0197998 | A1 | 7/2016 | Carleo |
| 2016/0251602 | A1 | 9/2016 | Steele et al. |
| 2016/0251603 | A1 | 9/2016 | Steele et al. |
| 2017/0051447 | A1 | 2/2017 | He et al. |
| 2017/0137983 | A1 | 5/2017 | He et al. |
| 2017/0240980 | A1 | 8/2017 | Feyisa et al. |
| 2017/0240981 | A1 | 8/2017 | Scott |
| 2017/0240982 | A1 | 8/2017 | Sadeghi |
| 2017/0241061 | A1 | 8/2017 | Wells et al. |
| 2017/0247771 | A1 | 8/2017 | Scott |
| 2017/0267949 | A1 | 9/2017 | Bird et al. |

FOREIGN PATENT DOCUMENTS

| | | | |
|---|---|---|---|
| CN | 202175862 | U | 3/2012 |
| CN | 102425053 | A | 4/2012 |
| CN | 102425055 | A | 4/2012 |
| CN | 202214631 | U | 5/2012 |
| CN | 202214633 | U | 5/2012 |
| CN | 202298219 | U | 7/2012 |
| CN | 202298220 | U | 7/2012 |
| CN | 202298222 | U | 7/2012 |
| CN | 202323458 | U | 7/2012 |
| CN | 202359387 | U | 8/2012 |
| CN | 202359388 | U | 8/2012 |
| CN | 202359389 | U | 8/2012 |
| CN | 202359390 | U | 8/2012 |
| CN | 202359396 | U | 8/2012 |
| CN | 202401272 | U | 8/2012 |
| CN | 202492706 | U | 10/2012 |
| CN | 20-2543632 | * | 11/2012 |
| CN | 20254363 | U | 11/2012 |
| CN | 202543632 | U | 11/2012 |
| CN | 202543635 | U | 11/2012 |
| CN | 202543646 | U | 11/2012 |
| CN | 202543652 | U | 11/2012 |
| CN | 102899848 | A | 1/2013 |
| CN | 202688698 | U | 1/2013 |
| CN | 202755220 | U | 2/2013 |
| CN | 202755221 | U | 2/2013 |
| CN | 102953249 | A | 3/2013 |
| CN | 102953250 | A | 3/2013 |
| CN | 102953262 | A | 3/2013 |
| CN | 102978870 | A | 3/2013 |
| CN | 103061084 | A | 4/2013 |
| CN | 103061085 | A | 4/2013 |
| CN | 103061086 | A | 4/2013 |
| CN | 103061087 | A | 4/2013 |
| CN | 103087839 | A | 5/2013 |
| CN | 103103720 | A | 5/2013 |
| CN | 103103721 | A | 5/2013 |
| CN | 103122566 | A | 5/2013 |
| CN | 103122567 | A | 5/2013 |
| CN | 202913242 | U | 5/2013 |
| CN | 103225192 | A | 7/2013 |
| CN | 203049283 | U | 7/2013 |
| CN | 103361934 | A | 10/2013 |
| CN | 103361938 | A | 10/2013 |
| CN | 203370359 | U | 1/2014 |
| CN | 103556439 | A | 2/2014 |
| CN | 203530695 | U | 4/2014 |
| CN | 203530700 | U | 4/2014 |
| CN | 203530714 | U | 4/2014 |
| CN | 203530718 | U | 4/2014 |
| CN | 203530723 | U | 4/2014 |
| CN | 203530725 | U | 4/2014 |
| CN | 103285643 | B | 4/2015 |
| CN | 103451894 | B | 11/2015 |
| CN | 103556434 | B | 11/2015 |
| CN | 103556436 | B | 11/2015 |
| CN | 103556431 | B | 1/2016 |
| CN | 103556432 | B | 3/2016 |
| CN | 105420992 | A | 3/2016 |
| CN | 105420993 | A | 3/2016 |
| CN | 105421000 | A | 3/2016 |
| CN | 105442267 | A | 3/2016 |
| CN | 205329373 | U | 6/2016 |
| CN | 205329374 | U | 6/2016 |
| CN | 205329380 | U | 6/2016 |
| CN | 205329384 | U | 6/2016 |
| DE | 3527724 | A1 | 2/1987 |
| DE | 3803195 | A1 | 8/1989 |
| DE | 102006031355 | A1 | 1/2008 |
| EP | 0635595 | A1 | 1/1995 |
| EP | 2749685 | A1 | 7/2014 |
| GB | 2473224 | A | 3/2011 |
| WO | WO-2010/094959 | A1 | 8/2010 |
| WO | WO-2011/064581 | A1 | 6/2011 |
| WO | WO-2011/098815 | A1 | 8/2011 |
| WO | WO-2012/098408 | A2 | 7/2012 |
| WO | WO-2013/016902 | A1 | 2/2013 |

OTHER PUBLICATIONS

U.S. Appl. No. 14/588,500, Xeros Ltd.
U.S. Appl. No. 15/588,510, Xeros Ltd.
U.S. Appl. No. 14/777,559, Xeros Ltd.
U.S. Appl. No. 14/777,568, Xeros Ltd.
U.S. Appl. No. 14/782,719, Xeros Ltd.
U.S. Appl. No. 14/782,729, Xeros Ltd.
U.S. Appl. No. 14/902,498, Xeros Ltd.
U.S. Appl. No. 14/902,506, Xeros Ltd.

(56) References Cited

OTHER PUBLICATIONS

International Search Report and Written Opinion for International Application No. PCT/GB2014/050856, dated May 13, 2014 (12 pages).
Search Report for United Kingdom Application No. GB1305122.2, dated Jul. 22, 2013 (3 pages).
U.S. Appl. No. 15/344,120, He et al.
U.S. Appl. No. 15/414,314, He et al.
U.S. Appl. No. 15/510,569, Xeros Ltd.
U.S. Appl. No. 15/510,576, Xeros Ltd.
U.S. Appl. No. 15/513,014, Xeros Ltd.
U.S. Appl. No. 15/513,309, Xeros Ltd.
U.S. Appl. No. 15/518,047, Xeros Ltd.

* cited by examiner

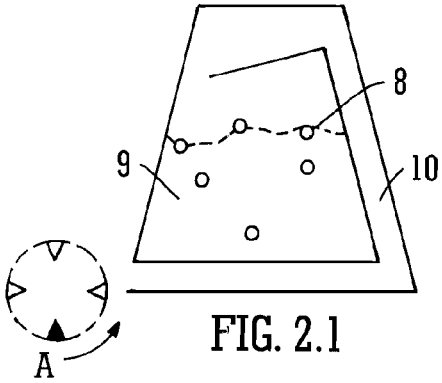
FIG. 2.1
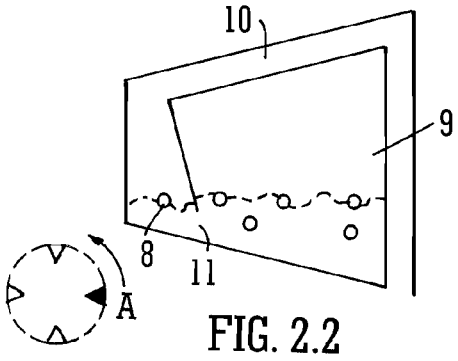
FIG. 2.2
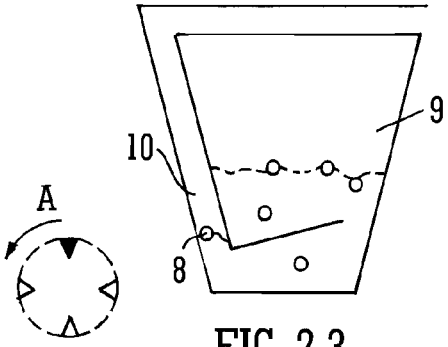
FIG. 2.3
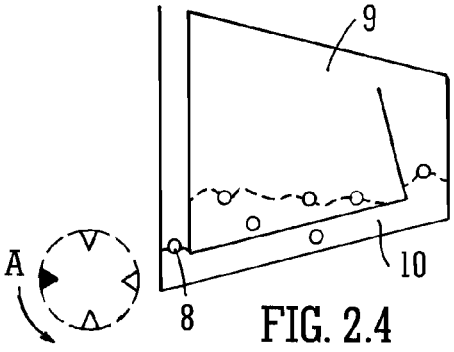
FIG. 2.4
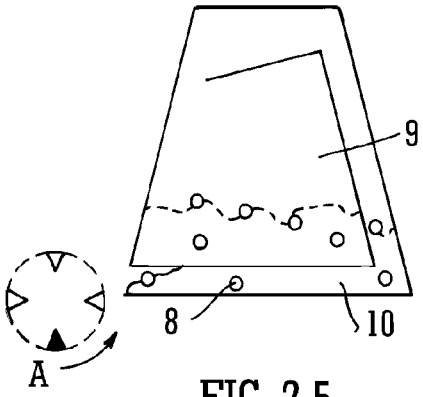
FIG. 2.5
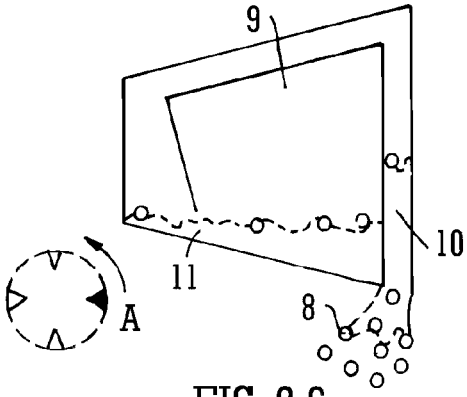
FIG. 2.6

CLEANING APPARATUS AND METHOD

FIELD OF THE INVENTION

The present invention relates to an apparatus for the treatment of substrates, specifically textile fibres and fabrics, using a system which comprises solid particulate material. More specifically, the invention is concerned with an apparatus which provides for the use of such solid particulate material in a system adapted to optimise mechanical interaction between said particulate material and substrates, and to facilitate the easy removal of said particulate material from said substrates after completion of the treatment, and their subsequent storage within the apparatus which facilitates their re-use for subsequent operations. The present invention also relates to a method for using said apparatus for treating a substrate.

BACKGROUND TO THE INVENTION

Aqueous cleaning processes are a mainstay of both domestic and industrial textile fabric washing. On the assumption that the desired level of cleaning is achieved, the efficacy of such processes is usually characterised by their levels of consumption of energy, water and detergent. In general, the lower the requirements with regard to these three components, the more efficient the washing process is deemed. The downstream effect of reduced water and detergent consumption is also significant, as this minimises the need for disposal of aqueous effluent, which is both extremely costly and detrimental to the environment.

Such washing processes, whether involving domestic washing machines or their industrial equivalents (usually referred to as washer extractors) involve aqueous submersion of fabrics followed by soil suspension, aqueous soil removal, and water rinsing. In general, the higher the level of energy (or temperature), water and detergent which is used, the better the cleaning. One significant issue, however, concerns water consumption, as this sets the energy requirements (in order to heat the wash water), and the detergent dosage (to achieve the desired detergent concentration). In addition, the water usage level defines the mechanical action of the process on the fabric, which is another significant performance parameter; this is the agitation of the cloth surface during washing, which plays a key role in releasing embedded soil. In aqueous processes, such mechanical action is provided by the water usage level in combination with the drum design for any particular washing machine. In general terms, it is found that the higher the water level in the drum, the better the mechanical action. Hence, there is a dichotomy created by the desire to improve overall process efficiency (i.e. the reduction of energy, water and detergent consumption), and the need for efficient mechanical action in the wash. For domestic washing in particular there are defined wash performance standards specifically designed to discourage the use of such higher levels of water in practice, in addition to the obvious cost penalties which are associated with such usage.

Current efficient domestic washing machines have made significant strides towards minimising their consumptions of energy, water and detergent. EU Directive 92/75/CEE sets a standard which defines washing machine energy consumption in kWh/cycle (cotton setting at 60° C.), such that an efficient domestic washing machine will typically consume <0.19 kWh/kg of washload in order to obtain an 'A' rating. If water consumption is also considered, then 'A' rated machines use <9.7 litres/kg of washload.

The most recent system in the EU (arising from Commission Delegated Regulation 1061/2010, introduced from 20 Dec. 2011) has, however, seen a switch to a new rating system for domestic washing machines. This considers annualised energy and water consumptions, and derives an energy efficiency index (EEI) based on a defined weekly set of wash cycles (3 off 60° C. at full load, 2 off 60° C. at half load, and 2 off 40° C. at half load). The total energy consumption of these washes (plus weighted values for the 'off mode' and 'left-on' mode power consumptions) is then averaged to a daily figure (by division by 7). The resulting figure is then multiplied by 220—the assumed average number of washes per annum, to calculate the annual energy consumption (AEc) in KWh.

The EEI is then calculated by dividing the AEc by a standard annual energy consumption (SAEc=[47×c]+51.7), where c is the washload capacity for the machine. An EEI value of <46 results in an A+++ energy efficiency rating. A similar approach is taken with the water consumption to arrive at the AWc (the water consumption for the same weekly set of wash cycles, averaged to daily consumption and annualised). This value is, however, simply displayed as an annual consumption in litres/annum.

Detergent dosage is then driven by manufacturer recommendations but, again, in the domestic market, for a concentrated liquid formulation, a figure of 35 ml (or 37 g) for a 4-6 kg washload in soft and medium hardness water, increasing to 52 ml (or 55 g) for a 6-8 kg washload (or in hard water or for very dirty items) is typical (see, for example, Unilever pack dosage instructions for Persil® Small & Mighty). Hence, for a 4-6 kg washload in soft/medium water hardness, this equates to a detergent dosage of 7.4-9.2 g/kg whilst, for a 6-8 kg washload (or in hard water or for very dirty items), the range is 6.9-9.2 g/kg.

Energy, water and detergent consumptions in the industrial washing process (washer extractors) are considerably different, however, and usages of all three resources are less constrained, since these are principal factors in reducing cycle time—which is, of course, more of a consideration than in the case of domestic processes. For a typical industrial washer extractor (25 kg washload rated and above), energy consumption is >0.30 kWh/kg, water usage is at ~20 litres/kg, and detergent is much more heavily dosed than for domestic washing. The exact level of detergent used will depend on the amount of soiling, but a range of 18-70 g/kg is representative.

Thus, it can be taken from the above discussion that it is the performance levels in the domestic sector which set the highest standard for an efficient fabric washing process, and that these are: an energy consumption of <0.19 kWh/kg or an EEI of <46, a water usage of <9.7 litres/kg, and a detergent dosage of approximately 8.0 g/kg (8.5 ml/kg). However, as previously observed, it is becoming increasingly difficult to reduce the water (and, hence, energy and detergent) levels in a purely aqueous process, due to the minimum requirement to wet the fabric thoroughly, the need to provide sufficient excess water to suspend the soil removed in an aqueous liquor and, finally, the need to rinse the fabric.

Heating of the wash water is then the principal use of energy, and a minimum level of detergent often becomes necessary to improve the cleaning performance. Means to improve mechanical action without increasing the water level used would, therefore, make any aqueous wash process significantly more efficient (i.e. yield further reductions in energy, water and detergent consumption). It should be noted that mechanical action itself has a direct effect on the detergent level, since the greater the level of soil removal which is achieved through physical force, the less that is required of the detergent chemistry. However, increasing the mechanical action in a purely aqueous washing process has certain associated drawbacks. Fabric creasing readily occurs in such processes, and this acts to concentrate the stresses from mechanical action at each crease, resulting in localised fabric damage. Prevention of such fabric damage (i.e. fabric care) is of primary concern to the domestic consumer and the industrial user.

In the light of these challenges which are associated with aqueous washing processes, the present inventors have previously devised a new approach to the problem, which allows the deficiencies demonstrated by the methods of the prior art to be overcome. The method which is provided eliminates the requirement for the use of large volumes of water, but is still capable of providing an efficient means of cleaning and stain removal, whilst also yielding economic and environmental benefits.

Thus, in WO-A-2007/128962 there is disclosed a method and formulation for cleaning a soiled substrate, the method comprising the treatment of the moistened substrate with a formulation comprising a multiplicity of polymeric particles, wherein the formulation is free of organic solvents. Preferably, the substrate is wetted so as to achieve a substrate to water ratio of between 1:0.1 to 1:5 w/w, and optionally, the formulation additionally comprises at least one cleaning material, which typically comprises a surfactant, which most preferably has detergent properties. In preferred embodiments, the substrate comprises a textile fibre and the polymeric particles may, for example, comprise particles of polyamides, polyesters, polyalkenes, polyurethanes or their copolymers, but are most preferably in the form of nylon beads.

The use of this particle-based cleaning method, however, presents a requirement for the cleaning particles to be efficiently separated from the cleaned substrate at the conclusion of the cleaning operation, and this issue is addressed in WO-A-2010/094959, which provides a novel design of cleaning apparatus requiring the use of two internal drums capable of independent rotation, and which finds application in both industrial and domestic cleaning processes.

In WO-A-2011/064581, there is provided a further apparatus which facilitates efficient separation of cleaning particles from the cleaned substrate at the conclusion of the cleaning operation, and which comprises a perforated drum and a removable outer drum skin which is adapted to prevent the ingress or egress of fluids and solid particulate matter from the interior of the drum, the cleaning method requiring attachment of the outer skin to the drum during a wash cycle, after which the skin is removed prior to operating a separation cycle to remove the cleaning particles, following which the cleaned substrate is removed from the drum.

In a further development of the apparatus of WO-A-2011/064581, there is disclosed in WO-A-2011/098815 a process and apparatus which provides for continuous circulation of the cleaning particles during the cleaning process, and thereby dispenses with the requirement for the provision of an outer skin.

In WO-A-2012/056252 the polymeric particle-based cleaning method, and the separation of said cleaning particles from the cleaned substrate, are both further improved by careful control of polymeric particle size, shape and density, as well as process parameters. A cleaning process is achieved which facilitates excellent cleaning performance at surprisingly low cleaning temperatures (i.e. low energy), and with reduced levels of added detergents, whilst also maintaining the original low water consumption.

In a further development of the cleaning method of WO-A-2012/056252, a process has been developed which meets the previously discussed targets for savings in energy consumption, water usage and detergent dosage whilst also facilitating reduced localised fabric damage in the washed substrate by virtue of the increased uniformity of the mechanical action of the particles with the fabric surface. Thus, in WO-A-2012/095677, there is disclosed a method for the cleaning of a soiled substrate which allows for the use of non-polymeric cleaning particles, and comprises treating the substrate with the non-polymeric particles and wash water in an apparatus comprising a drum comprising perforated side walls, wherein the solid particulate cleaning material may comprises a multiplicity of polymeric and non-polymeric particles. Thus, it has been established that the use of certain non-polymeric particles can enhance the mechanical action in the wash process such that, most particularly in combination with polymeric particles, there is a surprising benefit achieved in overall cleaning performance.

The apparatus and methods disclosed in the foregoing prior art documents have been highly successful in providing an efficient means of cleaning and stain removal which also yields significant economic and environmental benefits.

Even in view of the abovementioned advancements there still remains a need for further improvements. The present invention attempts to solve, at least in part, one or more of the following problems including: (i) maintaining the required amount of solid particulate material in the cage during cleaning, (ii) efficient separation of the solid particulate material after the cleaning steps, (iii) maintaining or improving cleaning performance, (iv) maintaining or improving fabric care, (v) maintaining or improving the cleaning efficiency per kg of dry substrate, (vi) storage of the solid particulate material, (vii) improved use of non-polymeric solid particulate materials, (viii) allowing the use of two different kinds of solid particulate materials and (ix) providing a simpler more economic cleaning apparatus and method. In embodiments, the present invention at least partially solves these problems using an apparatus which is suited to the demands of both industrial and especially domestic cleaning. Such apparatus (e.g. washing machines) can comprise a perforated drum which is adapted to allow the ingress or egress of fluids from the interior of the drum, but wherein the perforations are of such as size as to prevent the ingress and egress of solid particulate matter therethrough. Consequently, the present invention provides an apparatus which comprises of a rotatably mounted cylindrical cage and a means of collecting and storing solid particulate cleaning material therein and a cleaning method wherein the solid particulate cleaning material is released into the wash load during the wash cycle, and thereafter is collected and stored within the rotatably mounted cylindrical cage.

SUMMARY OF THE INVENTION

Thus, according to a first aspect of the present invention, there is provided an apparatus for use in the treatment of substrates using a solid particulate material, said apparatus comprising:

(a) housing means having mounted therein a rotatably mounted cylindrical cage;

(b) access means; and (c) a multiplicity of delivery means, wherein said rotatably mounted cylindrical cage additionally comprises storage means, adapted to facilitate storage of said solid particulate material.

In typical embodiments of the invention, said solid particulate material comprises a solid particulate cleaning material.

In certain embodiments of the invention, said rotatably mounted cylindrical cage comprises a drum comprising perforated side walls, wherein said perforations comprise holes having a diameter less than that of the particles of the solid particulate material. Typically, said holes have a diameter no greater than 5.0 mm. Thus, in said embodiments, said perforations permit the ingress and egress of fluids and fine particulate materials of lesser diameter than the holes, but are adapted so as to prevent the egress of solid particulate material having a particle diameter greater than 5.0 mm.

In especially typical embodiments of the invention, said perforations comprise holes having a diameter of less than 5.0 mm, most typically less than 3.0 mm. In such embodiments ingress and egress of all solid particulate material is typically prevented.

In alternative embodiments of the invention, said rotatably mounted cylindrical cage comprises a drum comprising solid side walls including no perforations such that, in operation, ingress and egress of any materials from the interior of drum is only possible via said storage means.

Typically, said storage means comprises at least one compartment comprising a flow path facilitating ingress and egress of fluids and solid particulate material.

In certain embodiments of the invention, said storage means comprises a plurality of said compartments.

In certain embodiments of the invention, said compartment or plurality of compartments may be located on at least one inner surface of said rotatably mounted cylindrical cage.

Embodiments of the invention envisage a plurality of compartments located, typically at equidistant intervals, on the inner circumferential surface of said rotatably mounted cylindrical cage.

In alternative embodiments of the invention, said plurality of compartments may be located on the inner end surface of said rotatably mounted cylindrical cage.

In some embodiments, said storage means is adapted such that ingress or egress of fluids and solid particulate material may be controlled by the direction of rotation of said rotatably mounted cylindrical cage. Thus, in embodiments of the invention wherein said storage means comprises at least one compartment comprising a flow path facilitating ingress and egress of fluids and solid particulate material, said ingress and egress is dependent on said direction of rotation.

The present invention also envisages apparatus wherein said storage means is retrofitted to apparatus of the prior art.

Said access means typically comprises a hinged door mounted in the casing, which may be opened to allow access to the inside of the cylindrical cage, and which may be closed in order to provide a substantially sealed system. Typically, the door includes a window. Optionally, said door also includes at least one addition port which facilitates the addition of materials to said rotatably mounted cylindrical cage.

Said rotatably mounted cylindrical cage may be mounted vertically within said housing means but, more generally, is mounted horizontally within said housing means. Consequently, in typical embodiments of the invention, said access means is located in the front of the apparatus, providing a front-loading facility. When the rotatably mounted cylindrical cage is vertically mounted within the housing means, the access means is located in the top of the apparatus, providing a top-loading facility. However, for the purposes of the further description of the present invention, it will be assumed that said rotatably mounted cylindrical cage is mounted horizontally within said housing means.

Rotation of said rotatably mounted cylindrical cage is effected by use of drive means, which typically comprises electrical drive means, in the form of an electric motor.

Operation of said drive means is effected by drive control means which may be programmed by an operative.

Said rotatably mounted cylindrical cage is of the size which is to be found in most commercially available washing machines and tumble dryers, and may have a capacity in the region of 10 to 7000 litres. Particular embodiments of the invention are concerned with domestic washing machines wherein a typical capacity would be in the region of 30 to 120 litres. However, other embodiments of the invention relate to industrial washer-extractors, wherein capacities anywhere in the range of from 120 to 7000 litres are possible. In the context of the cleaning of soiled substrates, a typical size in this range is that which is suitable for a 50 kg washload, wherein the drum has a volume of 450 to 650 litres and, in such cases, said cage would generally comprise a cylinder with a diameter in the region of 75 to 120 cm, typically from 90 to 110 cm, and a length of between 40 and 100 cm, typically between 60 and 90 cm. Generally, the cage will have 10 litres of volume per kg of washload to be cleaned.

In typical embodiments of the invention, said apparatus is designed to operate in conjunction with soiled substrates and cleaning media comprising a solid particulate material, which is most preferably in the form of a multiplicity of polymeric particles or a mixture of polymeric and non-polymeric particles. These particles are preferably required to be efficiently circulated to promote effective cleaning and the apparatus, therefore, optionally includes circulation means. Thus, the inner surface of the cylindrical side walls of said rotatably mounted cylindrical cage typically comprises a multiplicity of spaced apart elongated protrusions affixed essentially perpendicularly to said inner surface. Typically said apparatus comprises from 3 to 10, most preferably 4, of said protrusions, which are commonly referred to as lifters. In operation, agitation of the contents of the rotatably mounted cylindrical cage is provided by the action of said lifters on rotation of said cage.

Particular embodiments of the invention envisage an apparatus as hereinbefore defined wherein said storage means comprises a plurality of compartments located at equidistant intervals on the inner circumferential surface of said rotatably mounted cylindrical cage. In said embodiments, said plurality of compartments thereby additionally functions as a plurality of lifters.

Thus, in said embodiments, said lifters are adapted so as to store said solid particulate material and to facilitate controlled flow of solid particulate material between said lifter/storage means and the inside of the cylindrical cage. Most typically, said apparatus comprises a storage compartment of essentially equal length to said lifter, and adapted so as to provide a flow path from the compartment through an aperture in said lifter to the inside of said cage. Thus, in operation, for a given direction of rotation of said cage, particulate material present on the inner surface of said cage enters the lifters through the aperture and transports to the compartment housed therein via the flow path. For the opposite direction of rotation of said cage, particulate material exits the compartment via the same pathway and enters the cage. The dimensions of the apertures are selected in line with the dimensions of the solid particulate material, so as to allow efficient ingress and egress thereof.

In alternative embodiments of the invention, wherein said plurality of compartments is located on the inner end surface of said rotatably mounted cylindrical cage, said storage compartments are typically arranged in a circular array about the central axis of said cage and each compartment has a relatively large cross sectional areas and small overall depth, such that the arrangement of compartments does not significantly adversely impact the internal volume of the rotatably mounted cylindrical cage.

Said rotatably mounted cylindrical cage is mounted within said housing means, which, in turn, is connected to standard plumbing features, thereby providing a multiplicity of delivery means, by virtue of which at least water and, optionally, cleaning agents such as surfactants may be introduced into the apparatus. Said apparatus may additionally comprise means for circulating air within said housing means, and for adjusting the temperature and humidity therein. Said means may typically include, for example, a recirculating fan, an air heater, a water atomiser and/or a steam generator. Additionally, sensing means may also be provided for determining, inter alia, the temperature and humidity levels within the apparatus, and for communicating this information to the drive control means.

Optionally, said apparatus comprises a stationary member which is located adjacent said rotatably mounted cylindrical cage and comprises a multiplicity of delivery means mounted thereon, wherein said multiplicity of delivery means is adapted to facilitate the delivery of materials into said rotatably mounted cylindrical cage.

In embodiments of the invention, said delivery means may comprise spraying means, typically in the form of a spray head, which facilitates better distribution of materials delivered into said rotatably mounted cylindrical cage.

In certain embodiments of the invention, said rotatably mounted cylindrical cage is located within a first upper chamber of said housing means and beneath said first upper chamber is located a second lower chamber which functions as a sump. In said embodiments, said apparatus additionally comprises at least one recirculation means, thereby facilitating recirculation of fluids from said lower chamber to said rotatably mounted cylindrical cage. Typically, said recirculation means comprises pumping means and ducting which connects said lower chamber and said rotatably mounted cylindrical cage.

In operation, during a typical cycle for cleaning of a soiled substrate in an apparatus wherein said storage means is comprised in said lifters, soiled garments are first placed into said rotatably mounted cylindrical cage. The appropriate mass of solid particulate cleaning material is contained within said storage means before commencement of the washing cycle. Then, the necessary amount of water, together with any required additional cleaning agent, is added to said rotatably mounted cylindrical cage. via the delivery means or the addition port on the access means. These additives may, for example, be pre-mixed with water and optionally heated to the desired temperature.

In certain embodiments of the invention wherein the apparatus comprises a lower chamber, pre-mixing and heating may occur in said lower chamber and introduction of the mixture into the rotatably mounted cylindrical cage is effected by means of said recirculation means.

Concurrently with the addition of the necessary amount of water and cleaning agent to the apparatus, the rotatably mounted cylindrical cage commences rotation in a predetermined direction. Thus, by means of cage rotation and gravity, solid particulate cleaning material moves relative to said lifters/storage compartments along the flow paths such that, for each rotation of said cylindrical cage, a volume of solid particulate material is dispensed from said lifters, via the apertures in the lifters, into the soiled garments, until such time that the storage compartments have been emptied. Thereafter, the direction of rotation of the cage is, for the most part, maintained for the duration of the wash operation until cleaning is completed. On occasions during said wash operation, however, the direction of rotation of the cage may be reversed for short periods of time (typically less than 1 minute), in order to improve washing efficiency, principally by untangling soiled garments from each other.

Thereafter, on completion of the cleaning cycle, rotation of said rotatably mounted cylindrical cage is typically reversed. Thus, by means of cage rotation and gravity, said solid particulate material separates from the garments and enters the lifters/storage means, via the apertures in the lifters, and flows along the flow paths into the storage compartments such that, for each rotation of said cylindrical cage, a volume of solid particulate material is collected from the cage into the lifter storage compartments. This process continues until such time that all the solid particulate material has been separated from the garments and collected by said storage means.

In alternative embodiments of the invention, said rotatably mounted cylindrical cage comprises a drum comprising perforated side walls, wherein said perforations comprise holes having a diameter of no greater than 5.0 mm. Thus, in said embodiments, said perforations permit the ingress and egress of fluids and fine particulate materials, together with solid particulate materials of lesser diameter than the holes, but are adapted so as to prevent the egress of solid particulate material comprising particles of larger diameter.

In said embodiments, said rotatably mounted cylindrical cage is located within a first upper chamber of said housing means and beneath said first upper chamber is located a second lower chamber which functions as a collection chamber for said larger diameter particulate media. Typically, said lower chamber comprises a sump, which is typically an enlarged sump.

In said embodiments, said apparatus comprises at least one recirculation means, which facilitates recirculation of said larger diameter solid particulate material from said lower chamber to said rotatably mounted cylindrical cage, for re-use in cleaning operations. Typically, said first recirculation means comprises ducting connecting said second chamber and said rotatably mounted cylindrical cage. Most particularly, said ducting comprises separating means for separating said solid particulate material from water and control means, adapted to control entry of said solid particulate material into said cylindrical cage.

Recirculation of solid particulate matter from said lower chamber to said rotatably mounted cylindrical cage is achieved by the use of pumping means comprised in said first recirculation means, wherein said pumping means is adapted to deliver said solid particulate matter to said separating means and said control means, adapted to control the re-entry of said solid particulate matter into said rotatably mounted cylindrical cage.

In embodiments of the invention, said apparatus additionally includes a second recirculation means, allowing for the return of water separated by said separating means to said lower chamber, thereby facilitating re-use of said water in an environmentally beneficial manner.

Optionally, said lower chamber comprises additional pumping means to promote circulation and mixing of the contents thereof, in addition to heating means, allowing the contents to be raised to a preferred temperature of operation.

In certain embodiments of the invention, said solid particulate material retained in said rotatably mounted cylindrical cage comprises the same material, but having a different particle size, to that which falls into the lower chamber. As a consequence, it is possible to reduce the size of the lower chamber and thereby simplify the machine design.

In alternative embodiments, solid particulate material retained in said rotatably mounted cylindrical cage may be comprised of a different material, as well as having a different particle size, to that which falls into the lower chamber. When performing cleaning operations, this has the advantage of allowing for the use of different particulate materials which demonstrate alternative cleaning performances and these may be used collectively or individually according to the substrate types.

Further embodiments of the present invention allow for the use of non-polymeric particulate materials having a density which is too high to allow for efficient recirculation from said lower chamber to said rotatably mounted cylindrical cage, since these particles may be retained within said cage in the storage means, whilst polymeric particulate materials can fall into said lower chamber from where, in view of their lower density, they may be efficiently recirculated to said rotatably mounted cylindrical cage. Said embodiments provide the combined benefits of allowing for reductions in the size of the lower chamber, thereby simplifying the machine design, and also facilitating the use of different particulate materials demonstrating alternative cleaning performances, which may be used collectively or individually, most particularly in cleaning operations, according to the substrate types in order to improve overall cleaning performance.

According to a second aspect of the present invention, there is provided a method for treating a substrate, said method comprising the treatment of the substrate with a formulation comprising solid particulate material, wherein said method is carried out in an apparatus according to the first aspect of the invention. For methods wherein the treatment is a cleaning treatment, the substrate can comprise at least one soiled substrate and, in typical embodiments, the at least one soiled substrate comprises at least one textile fibre, which is preferably in the form of a garment. More particularly, in certain embodiments of the invention, said method comprises the cleaning of a soiled substrate with a formulation comprising solid particulate cleaning material and wash water, wherein said method is carried out in an apparatus according to the first aspect of the invention.

In particular embodiments of the invention, wherein said rotatably mounted cylindrical cage is located within a first upper chamber of the housing means of said apparatus, and beneath said first upper chamber is located a second lower chamber, said method comprises the steps of:

(a) introducing water into the second lower chamber of an apparatus according to the first aspect of the invention;
(b) heating said water;
(c) loading at least one soiled substrate into said rotatably mounted cylindrical cage via access means;
(d) closing the access means so as to provide a substantially sealed system;
(e) introducing said water into said rotatably mounted cylindrical cage via recirculating means;
(f) operating the apparatus for a wash cycle, wherein said rotatably mounted cylindrical cage is caused to rotate and said solid particulate cleaning material is caused to dispense from said storage means in a manner controlled by said rotation of said cage; and
(g) continuing with steps (f) as required to effect leaning of the soiled substrate.

Typically, additional cleaning agents are employed in said method. Said additional cleaning agents are typically premixed with water and the mixture is optionally heated prior to addition to said cylindrical cage via delivery means or an addition port located on said access means. In certain embodiments of the invention, said addition may be effected via spraying means, such as a spray head, in order to better distribute said cleaning agents in the washload.

The generation of suitable G forces, in combination with the action of the solid particulate cleaning material, is a key factor in achieving an appropriate level of cleaning of the soiled substrate. G is a function of the cage size and the speed of rotation of the cage and, specifically, is the ratio of the centripetal force generated at the inner surface of the cage to the static weight of the washload. Thus, for a cage of inner radius r (m), rotating at R (rpm), with a washload of mass M (kg), and an instantaneous tangential velocity of the cage v (m/s), and taking g as the acceleration due to gravity at 9.81 m/s$^2$:

Centripetal force=$Mv^2/r$

Washload static weight=$Mg$ $v=2\pi rR/60$ $$\text{Hence, } G=4\pi^2r^2R^2/3600rg=4\pi^2rR^2/3600g=1.118\times10^{-3}rR^2$$

When, as is usually the case, r is expressed in centimetres, rather than metres, then:

$$G=1.118\times10^{-5}rR^2$$

Hence, for a drum of radius 49 cm rotating at 800 rpm, G=350.6.

In a particular embodiment of the invention, a cylindrical drum having a diameter of 98 cm is rotated at a speed of 30-800 rpm in order to generate G forces of 0.49-350.6 at different stages during the cleaning process. In examples of alternative embodiments of the invention, a 48 cm diameter drum rotating at 1600 rpm can generate 687 G, whilst a 60 cm diameter drum at the same speed of rotation generates 859 G.

In typical embodiments of the invention, the claimed method additionally provides for separation and recovery of the solid particulate cleaning material by collection in the storage means located within said rotatably mounted cylindrical cage. Said solid particulate cleaning material may then be re-used in subsequent washes.

During the wash cycle, rotation of said rotatably mounted cylindrical cage is preferably caused to occur at rotation speeds such that G is <1 which, for a 98 cm diameter cage, requires a rotation speed of up to 42 rpm, with preferred rates of rotation being between 30 and 40 rpm.

Typically, on completion of the wash cycle, rotation of said rotatably mounted cylindrical cage can be caused to occur at a G force of less than 1 so as to allow for removal of the solid particulate cleaning material, preferably to the storage means. On completion of the wash cycle, the speed of rotation of the cage can initially be increased in order to effect a measure of drying of the cleaned substrate, thereby generating G forces of between 10 and 1000, more specifically between 40 and 400. Typically, for a 98 cm diameter cage, rotation is at a speed of up to 800 rpm in order to achieve this effect. Subsequently, the direction of rotation is reversed and the rotation speed is reduced to the speed of the wash cycle so as to allow for collection and storage of said solid particulate cleaning material in said storage means located in said rotatably mounted cylindrical cage.

Optionally, following said solid particulate material collection operation, said method may additionally comprise a rinsing operation, wherein additional water may be added to said rotatably mounted cylindrical cage, preferably in order to effect complete removal of any additional cleaning agent employed in the cleaning operation. Water may be added to said cylindrical cage via said delivery means or said addition port mounted on said access door. Again, addition may optionally be carried out by means of a spray head in order to achieve better distribution of the rinsing water in the washload. Alternatively, where appropriate, said addition may be achieved by overfilling the second, lower chamber of said apparatus with water such that it enters the first, upper chamber and thereby partially submerges said rotatably mounted cylindrical cage and enters into said cage.

Following rotation at the same speed as during the wash cycle, water is removed from said cage by allowing the water level to fall as appropriate and, whatever method of rinse water addition is employed, the speed of rotation of the cage is then increased so as to achieve a measure of drying of the substrate. Typically, for a 98 cm diameter cage, rotation is at a speed of up to 800 rpm in order to achieve this effect. Subsequently, rotation speed is reduced and returned to the speed of the wash cycle, thereby allowing for final collection of any remaining solid particulate cleaning material. Said rinsing and drying cycles may be repeated as often as desired.

Optionally, said rinse cycle may be used for the purposes of substrate treatment, involving the addition of treatment agents such as anti-redeposition additives, optical brighteners, perfumes, softeners and starch to the rinse water.

Said solid particulate cleaning material is optionally subjected to a cleaning operation in said storage means located in said rotatably mounted cylindrical cage by introducing water, optionally together with a cleaning agent such as a surfactant, into said rotatably mounted cylindrical cage, and thereby into said storage means and rinsing said solid particulate material. Optionally, this water may be heated.

Generally, any remaining solid particulate cleaning material on said at least one substrate may be easily removed by shaking the at least one substrate. If necessary, however, further remaining solid particulate cleaning material may be removed by suction means, preferably comprising a vacuum wand.

Additionally, in alternative embodiments of the invention, said apparatus finds application in methods for the drying of wet substrates, said methods comprising treating the substrates with a solid particulate material at ambient or elevated temperature, said treatments being carried out in an apparatus according to a first aspect of the invention. In such an embodiment the substrate typically comprises at least one textile fibre, more typically at least one textile fibre garment

BRIEF DESCRIPTION OF THE DRAWINGS

The invention will now be further illustrated by reference to the following drawings, wherein:

FIG. 2 shows the mode of operation of a particular embodiment of storage means comprised in the apparatus of the invention;

DETAILED DESCRIPTION OF THE INVENTION

Figure 1:
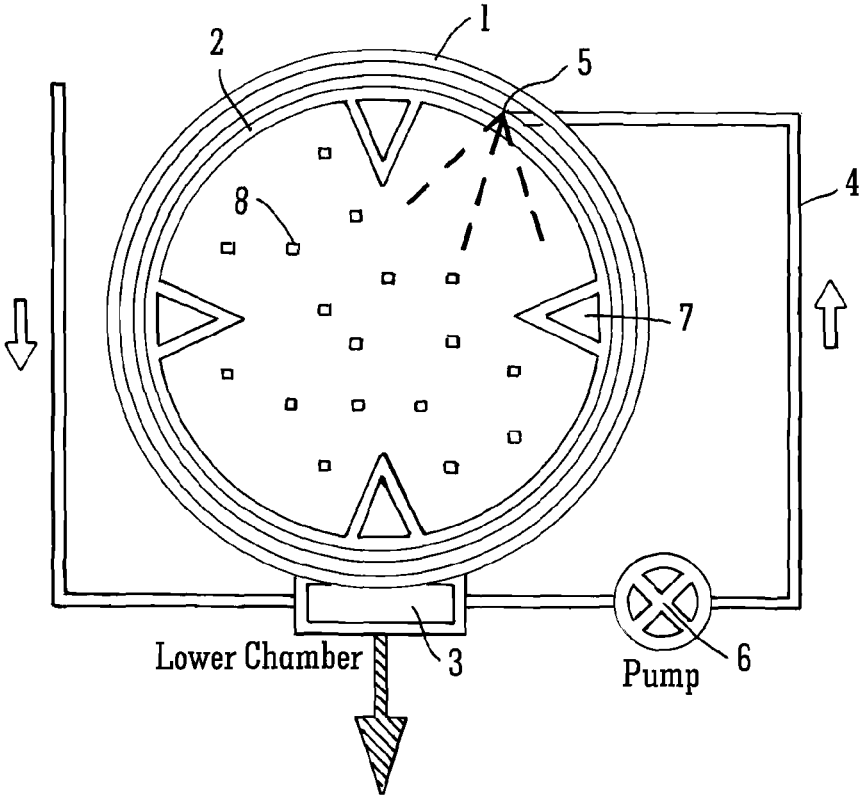
FIG. 1 shows an apparatus according to an embodiment of the invention wherein recirculation of solid particulate material is not employed.

The apparatus according to the invention may be used for the treatment of any of a wide range of substrates including, for example, plastics materials, leather, paper, cardboard, metal, glass or wood. In practice, however, said apparatus is principally designed for use in the cleaning of substrates, specifically those comprising a textile fibre, such as textile fibre garments, and has been shown to be particularly successful in achieving efficient cleaning of textile fibres which may, for example, comprise either natural fibres, such as cotton, or man-made and synthetic textile fibres, for example nylon 6,6, polyester, cellulose acetate, or fibre blends thereof.

Most preferably, the solid particulate cleaning material comprises a multiplicity of polymeric particles or a mixture of polymeric particles and non-polymeric particles. The particles are of such a shape and size as to allow for good flowability and intimate contact with the soiled substrate. A variety of shapes of particles can be used, such as cylindrical, spherical or cuboid; appropriate cross-sectional shapes can be employed including, for example, annular ring, dog-bone and circular. Non-polymeric particles comprising naturally occurring materials such as stone may have various shapes, dependent on their propensity to cleave in a variety of different ways during manufacture. Most preferably, however, said particles comprise cylindrical or spherical beads.

The polymeric particles may comprise either foamed or unfoamed polymeric materials. Furthermore, the polymeric particles may comprise polymers which are either linear or crosslinked.

The polymeric particles typically comprise polyalkenes such as polyethylene and polypropylene, polyamides, polyesters or polyurethanes. More particularly, however, said polymeric particles comprise polyamide or polyester particles, most particularly particles of nylon, polyethylene terephthalate or polybutylene terephthalate, typically in the form of beads. Said polyamides and polyesters are found to be particularly effective for aqueous stain/soil removal, whilst polyalkenes are especially useful for the removal of oil-based stains.

Various nylon or polyester homo- or co-polymers may be used including, but not limited to, Nylon 6, Nylon 6,6, polyethylene terephthalate and polybutylene terephthalate. Preferably, the nylon comprises Nylon 6,6 polymer, preferably having a molecular weight in the region of from 5000 to 30000 Daltons, more preferably from 10000 to 20000 Daltons, most preferably from 15000 to 16000 Daltons. The polyester will typically have a molecular weight corresponding to an intrinsic viscosity measurement in the range of from 0.3-1.5 dl/g as measured by a solution technique such as ASTM D-4603.

Optionally, copolymers of the above polymeric materials may be employed for the purposes of the invention. Specifically, the properties of the polymeric materials may be tailored to specific requirements by the inclusion of monomeric units which confer particular properties on the copolymer. Thus, the copolymers may be adapted to attract particular staining materials by comprising monomers which, inter alia, are ionically charged, or include polar moieties or unsaturated organic groups.

The non-polymeric particles may comprise particles of glass, silica, stone, wood, or any of a variety of metals or ceramic materials. Suitable metals include, but are not limited to, zinc, titanium, chromium, manganese, iron, cobalt, nickel, copper, tungsten, aluminium, tin and lead, and alloys thereof. Suitable ceramics include, but are not limited to, alumina, zirconia, tungsten carbide, silicon carbide and silicon nitride.

In further embodiments of the invention, said non-polymeric particles may comprise coated non-polymeric particles. Most particularly, said non-polymeric particles may comprise a non-polymeric core material and a shell comprising a coating of a polymeric material. In a particular embodiment, said core may comprise a metal core, typically a steel core, and said shell may comprise a polyamide coating, for example a coating of nylon.

It has been established that the combination of particle size, shape and density is such that the mechanical action of the particle with the fabric is optimised, it being sufficiently vigorous to provide effective cleaning but, at the same time, uniform and gentle enough to reduce fabric damage when compared with conventional aqueous processes. It is, in particular, the uniformity of the mechanical action generated by the chosen particles across the entire fabric surface that is the key factor in this regard. The particle parameters are also controlled so as to allow for easy separation of the particles from the fabric washload at the end of the wash process. Thus, particle size and shape may be controlled in order to minimise entanglement with the fabric, and the combination of suitable particle density with low G (<1) and high free volume in the washing machine tumbling process together promote particle removal to the storage means located on the inner surface of the rotatably mounted cylindrical cage.

All particles may have smooth or irregular surface structures and can be of solid or hollow construction. Non-polymeric particles typically have an average density in the range of from 3.5-12.0 g/cm$^3$, more typically from 5.0-10.0 g/cm$^3$, most typically from 6.0-9.0 g/cm$^3$. Polymeric particles typically have an average density in the range of 0.5-2.5 g/cm$^3$, more typically from 0.55-2.0 g/cm$^3$, most typically from 0.6-1.9 g/cm$^3$. The average volume of both the non-polymeric and polymeric particles is typically in the range of 5-275 mm$^3$, more typically from 8-140 mm$^3$, most typically from 10-120 mm$^3$.

In the case of cylindrical particles—both non-polymeric and polymeric—of oval cross section, the major cross section axis length, a, is typically in the range of from 2.0-6.0 mm, more typically from 2.2-5.0 mm, most typically from 2.4-4.5 mm, and the minor cross section axis length, b, is typically in the range of from 1.3-5.0 mm, more typically from 1.5-4.0 mm, and most typically from 1.7-3.5 mm (a>b). The length of such particles, h, is typically from 1.5-6.0 mm, more typically from 1.7-5.0 mm, and most typically from 2.0-4.5 mm (h/b is typically in the range of from 0.5-10).

For cylindrical particles—both non-polymeric and polymeric—of circular cross section, the typical cross section diameter, $d_c$, is in the range of from 1.3-6.0 mm, more typically from 1.5-5.0 mm, and most typically from 1.7-45.5 mm. The typical length, $h_c$, of such particles is again from 1.5-6.0 mm, more typically from 1.7-5.0 mm, and most typically from 2.0-4.5 mm ($h_c/d_c$ is typically in the range of from 0.5-10).

In the case of both non-polymeric and polymeric spherical particles (not perfect spheres) the diameter, $d_s$, is typically in the range of from 2.0-8.0 mm, more typically in the range of from 2.2-5.5 mm, and most typically from 2.4-5.0 mm.

In embodiments where the particles, whether non-polymeric or polymeric, are perfect spheres, the diameter, $d_{ps}$, is typically in the range of from 2.0-8.0 mm, more typically from 3.0-7.0 mm, and most typically from 4.0-6.5 mm.

The selection of specific particle type (polymeric and non-polymeric, when used) for a given cleaning operation is particularly significant in optimising fabric care. Thus, particle size, shape, mass and material must all be considered carefully in respect of the particular substrate which is to be cleaned, so that particle selection is dependent on the nature of the garments to be cleaned, i.e. whether they comprise cotton, polyester, polyamide, silk, wool, or any of the other common textile fibres or blends which are commonly in use.

In order to provide additional lubrication to the cleaning system and thereby improve the transport properties within the system, water is added to the system. Thus, more efficient transfer of the at least one cleaning material to the substrate is facilitated, and removal of soiling and stains from the substrate occurs more readily. Optionally, the soiled substrate may be moistened by wetting with mains or tap water prior to loading into the apparatus of the invention. In any event, water is added to the rotatably mounted cylindrical cage of the apparatus according to the invention such that the washing treatment is carried out so as to achieve a water to substrate ratio which is typically between 2.5:1 and 0.1:1 w/w; more typically, the ratio is between 2.0:1 and 0.8:1, with particularly favourable results having been achieved at ratios such as 1.75:1, 1.5:1, 1.2:1 and 1.1:1. Most conveniently, the required amount of water is introduced into the rotatably mounted cylindrical cage of the apparatus according to the invention after loading of the soiled substrate into said cage.

Whilst, in one embodiment, the method of the invention envisages the cleaning of a soiled substrate by the treatment of a moistened substrate with a formulation which essentially consists only of a multiplicity of polymeric particles or a multiplicity of polymeric and non-polymeric particles in the absence of any further additives, optionally in other embodiments the formulation employed may additionally comprise at least one cleaning agent. Said at least one cleaning agent may typically comprise at least one detergent composition. Optionally, said at least one cleaning agent is mixed with said polymeric particles or mixture of polymeric and non-polymeric particles but, in a particular embodiment, each of said polymeric particles is coated with said at least one cleaning agent.

The principal components of the detergent composition comprise cleaning components and post-treatment components. Typically, the cleaning components comprise surfactants, enzymes and bleach, whilst the post-treatment components include, for example, anti-redeposition additives, perfumes and optical brighteners.

However, the detergent formulation may optionally include one or more other additives such as, for example builders, chelating agents, dye transfer inhibiting agents, dispersants, enzyme stabilizers, catalytic materials, bleach activators, polymeric dispersing agents, clay soil removal agents, suds suppressors, dyes, structure elasticizing agents, fabric softeners, starches, carriers, hydrotropes, processing aids and/or pigments.

Examples of suitable surfactants may be selected from non-ionic and/or anionic and/or cationic surfactants and/or ampholytic and/or zwitterionic and/or semi-polar nonionic surfactants. The surfactant is typically present at a level of from about 0.1%, from about 1%, or even from about 5% by weight of the cleaning compositions to about 99.9%, to about 80%, to about 35%, or even to about 30% by weight of the cleaning compositions.

The compositions may include one or more detergent enzymes which provide cleaning performance and/or fabric care benefits. Examples of suitable enzymes include, but are not limited to, hemicellulases, peroxidases, proteases, other cellulases, other xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, and amylases, or mixtures thereof. A typical combination may comprise a mixture of enzymes such as protease, lipase, cutinase and/or cellulase in conjunction with amylase.

Optionally, enzyme stabilisers may also be included amongst the cleaning components. In this regard, enzymes for use in detergents may be stabilised by various techniques, for example by the incorporation of water-soluble sources of calcium and/or magnesium ions in the compositions.

The compositions may include one or more bleach compounds and associated activators. Examples of such bleach compounds include, but are not limited to, peroxygen compounds, including hydrogen peroxide, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N, N'-phthaloylaminoperoxycaproic acid and amidoperoxyacid. Bleach activators include, but are not limited to, carboxylic acid esters such as tetraacetylethylenediamine and sodium nonanoyloxybenzene sulphonate.

Suitable builders may be included in the formulations and these include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

The compositions may also optionally contain one or more copper, iron and/or manganese chelating agents and/or one or more dye transfer inhibiting agents.

Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Optionally, the detergent formulations can also contain dispersants. Suitable water-soluble organic materials are the homo- or co-polymeric acids or their salts, in which the polycarboxylic acid may comprise at least two carboxyl radicals separated from each other by not more than two carbon atoms.

Said anti-redeposition additives are physico-chemical in their action and include, for example, materials such as polyethylene glycol, polyacrylates and carboxy methyl cellulose.

Optionally, the compositions may also contain perfumes Suitable perfumes are generally multi-component organic chemical formulations which can contain alcohols, ketones, aldehydes, esters, ethers and nitrile alkenes, and mixtures thereof. Commercially available compounds offering sufficient substantivity to provide residual fragrance include Galaxolide (1,3,4,6,7,8-hexahydro-4,6,6,7,8,8-hexamethylcyclopenta(g)-2-benzopyran), Lyral (3- and 4-(4-hydroxy-4-methyl-pentyl) cyclohexene-1-carboxaldehyde and Ambroxan ((3aR,5aS,9aS,9bR)-3a,6,6,9a-tetramethyl-2,4,5,5a,7,8,9,9b-octahydro-1H-benzo[e][1] benzofuran). One example of a commercially available fully formulated perfume is Amour Japonais supplied by Symrise® AG.

Suitable optical brighteners fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds include, but are not limited to, 4,4'-bis[[6-anilino-4(methylamino)-1,3,5-triazin-2-yl]amino]stilbene-2,2'-disulphonic acid, 4,4'-bis[[6-anilino-4-[(2-hydroxyethyl)methylamino]-1,3,5-triazin-2-yl]amino]stilbene-2,2'-disulphonic acid, disodium salt, 4,4'-Bis[[2-anilino-4-[bis(2-hydroxyethyl)amino]-1,3,5-triazin-6-yl]amino]stilbene-2,2'-disulphonic acid, disodium salt, 4,4'-bis[(4,6-dianilino-1,3,5-triazin-2-yl)amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulphonic acid, disodium salt, and 2,5-bis(benzoxazol-2-yl)thiophene.

Said agents may be used either alone or in any desired combination and may be added to the cleaning system at appropriate stages during the cleaning cycle in order to maximise their effects.

In any event, however, when the method of the invention is performed in the presence of at least one additional cleaning agent, the quantity of said cleaning agent required in order to achieve satisfactory cleaning performance is significantly reduced from the quantities required with the methods of the prior art.

The ratio of solid particulate cleaning material to substrate is generally in the range of from 0.1:1 to 10:1 w/w, more typically in the region of from 0.5:1 to 5:1 w/w, with particularly favourable results being achieved with a ratio of between 1:1 and 3:1 w/w, and especially at around 2:1 w/w. Thus, for example, for the cleaning of 5 g of fabric, 10 g of polymeric particles, optionally coated with surfactant, would be employed in one embodiment of the invention. The ratio of solid particulate cleaning material to substrate is maintained at a substantially constant level throughout the wash cycle.

The apparatus and the method of the present invention may be used for either small or large scale batchwise processes and find application in industrial and, most particularly, domestic cleaning processes. By small scale in this context is typically meant less than or equal to 220 washing cycles per year, whilst large scale typically means more than 220 washing cycles per year.

As previously noted, the method of the invention finds particular application in the cleaning of textile fibres. The conditions employed in such a cleaning system do, however, allow the use of significantly reduced temperatures from those which typically apply to the conventional wet cleaning of textile fabrics and, as a consequence, offer significant environmental and economic benefits. Thus, typical procedures and conditions for the wash cycle require that fabrics are generally treated according to the method of the invention at, for example, temperatures of between 5 and 95° C., typically for a duration of between 5 and 120 minutes in a substantially sealed system. Thereafter, additional time is required for the completion of the rinsing and bead separation stages of the overall process, so that the total duration of the entire cycle is typically in the region of 1 hour. The preferred operating temperatures for the method of the invention are in the range of from 10 to 60° C. and, more preferably, from 15 to 40° C.

The cycle for collection and storage of solid particulate material may optionally be performed at room temperature and it has been established that optimum results are achieved at cycle times of between 2 and 30 minutes, preferably between 5 and 20 minutes.

The results obtained are very much in line with those observed when carrying out conventional wet (or dry) cleaning procedures with textile fabrics. The extent of cleaning and stain removal achieved with fabrics treated by the method of the invention is seen to be very good, with particularly outstanding results being achieved in respect of hydrophobic stains and aqueous stains and soiling, which are often difficult to remove. The energy requirement, the total volume of water used, and the detergent consumption of the method of the invention are all significantly lower than those levels associated with the use of conventional aqueous washing procedures, again offering significant advantages in terms of cost and environmental benefits.

The method of the invention also shows benefits in terms of reducing washing-related fabric damage. As previously observed, fabric creasing readily occurs in conventional aqueous washing, and this acts to concentrate the stresses from the mechanical action of the wash at each crease, resulting in localised fabric damage. Prevention of such fabric damage (or fabric care) is of primary concern to the domestic consumer and industrial user. The use of polymeric particles, or mixtures of non-polymeric and polymeric particles, according to the method of the invention effectively reduces creasing in the wash by acting as a pinning layer on the fabric surface in order to help prevent the folding action. The particles also inhibit interaction between separate pieces of fabric in the wash by acting as a separation or spacing layer, thereby reducing entanglement which is another major cause of localised fabric damage. In the presently disclosed method, mechanical action is still present but, critically, this is much more uniformly distributed as a result of the action of the particles. It is the localised aspect of the damage that determines the lifetime of a garment under multiple washing.

Additionally, it has been demonstrated that re-utilisation of the polymeric and non-polymeric particles is possible, allowing for the performance of multiple washes with the same solid particulate cleaning material. Re-use of the particles in this way for repeat cleaning procedures provides significant economic benefits and satisfactory results are achieved after multiple washes, although it generally found that some deterioration in performance is eventually observed.

Additionally, in alternative embodiments of the invention, said apparatus finds application in methods for the drying of wet substrates, said methods comprising treating the substrates with a solid particulate material at ambient or elevated temperature, said treatments being carried out in an apparatus according to a first aspect of the invention.

In said embodiments, the method finds particular application in the drying of textile fabrics. The conditions employed in such systems allow the use of significantly reduced temperatures from those which typically apply to the conventional tumble drying of textile fabrics and, as a consequence, offer significant environmental and economic benefits. Thus, typical procedures and conditions for the drying cycle require that fabrics are generally treated according to the method of the invention at, for example, temperatures of between 20 and 80° C. for a duration of between 5 and 55 minutes. Thereafter, additional time is required for the completion of the particle separation stage of the overall process, so that the total duration of the entire cycle is typically in the region of 1 hour.

Suitable drying procedures are fully disclosed in co-pending patent application WO-A-2012/098408, the contents of which are hereby incorporated by reference.

The results obtained in such drying operations are very much in line with those observed when carrying out conventional tumble drying procedures with textile fabrics. The extent of water removal achieved with fabrics treated by the method of the present invention is seen to be very good. The temperature requirement is significantly lower than the levels associated with the use of conventional tumble drying procedures, again offering significant advantages in terms of cost and environmental benefits.

The method of the invention also shows benefits in terms of reducing drying-related fabric damage. As previously observed, fabric creasing readily occurs in conventional tumble drying, and this acts to concentrate the stresses from the mechanical action of the drying process at each crease, resulting in localised fabric damage. Prevention of such fabric damage (or fabric care) is of primary concern to the domestic consumer and industrial user. The addition of particles according to the method of the invention effectively reduces creasing in the process by acting as a pinning layer on the fabric surface in order to help prevent the folding action. The particles also inhibit interaction between separate pieces of fabric in the drying process by acting as a separation or spacing layer, thereby reducing entanglement which is another major cause of localised fabric damage. In the presently disclosed method, mechanical action is still present but, critically, this is much more uniformly distributed as a result of the action of the particles. It is the localised aspect of the damage that determines the lifetime of a garment under multiple drying processes.

As previously disclosed, certain embodiments of the invention provide an apparatus wherein said rotatably mounted cylindrical cage comprises a drum comprising perforated side walls, wherein the side walls comprise perforations comprising holes having a diameter of no greater than 3.0 mm, wherein said perforations permit the ingress and egress of fluids and fine particulate materials of lesser diameter than the holes, but are adapted so as to prevent the egress of said solid particulate material.

Said embodiments show benefits over prior art systems by requiring a lower mass of solid particulate cleaning material. Thus, in an apparatus which relies purely on recirculation of solid particulate material during cleaning operations, as described in WO-A-2011/098815, a proportion of the overall mass of solid particulate cleaning material is not interacting with the soiled substrate in the drum, as it is in the respective recirculation means. In the case of the disclosed embodiments of the present invention, however, solid particulate cleaning material is retained in the drum at all times, so that a relatively smaller mass of cleaning material can be used. Furthermore, these embodiments of the apparatus of the present invention, having an in-drum cleaning material storage means, dispense with the requirement for the provision of a recirculation means, and this has corresponding benefits of reducing component count and cost, and of simplifying component layout and packaging within the constraints of the machine envelope. This is of particular relevance for a domestic EU washing machine, where packaging of a recirculation means presents difficult technical challenges.

Again, as previously disclosed, alternative embodiments of the present invention provide an apparatus wherein said rotatably mounted cylindrical cage comprises a drum comprising perforated side walls, wherein the perforations comprise holes having a diameter of no greater than 5.0 mm, wherein said perforations permit the ingress and egress of fluids and fine particulate materials, together with solid particulate materials of lesser diameter than the holes, but are adapted so as to prevent the egress of solid particulate material comprising particles of larger diameter. Said embodiments additionally comprise recirculation means.

Said embodiments show benefits over prior art systems by, in the first instance, providing in-drum cleaning material storage means, thereby reducing the storage volume required in the lower chamber and, as such, simplifying the subsequent layout of machine components within the given machine envelope. Furthermore, the provision of separate storage of cleaning material of different specification allows for the individual or collective use of said particles to optimise the cleaning performance in terms of bead mass and cleaning properties to suit particular soiling levels or fabric types. In a further instance, having in-drum cleaning material storage means for use with non-polymeric particles provides a solution to the problem of finding effective storage, since their high density potentially causes difficulties in their use in an apparatus comprising recirculation means.

Furthermore, it is believed that additional benefits in terms of fabric care are associated with the use of apparatus wherein the rotatably mounted cylindrical cage has perforations which do not exceed 5.0 mm in diameter and which, in certain embodiments, are 3.0 mm or less in diameter, or are not present at all.

In a typical example of an operating cycle according to the method of the invention, rotation of the cage commences in a single direction at around 40 rpm, releasing solid particulate cleaning material (approximately 12.6 kg) from storage means comprised in a series of lifters located in the inner surface of the cylindrical walls of the cage to a washload of soiled substrate (7 kg) in a rotatably mounted cylindrical cage of 48 cm diameter. Thus, during the wash cycle, the solid particulate cleaning material is retained within the rotatably mounted cylindrical cage, where it interacts with the washload of soiled substrate. The rate of interaction of the solid particulate cleaning material with the washload is essentially controlled by means of the rotatably mounted cylindrical cage design and rotation. The key parameters in this regard include the size and number of lifters, and the speed and direction of the cylindrical cage rotation.

In an apparatus designed for use in a method which requires no recirculation of the solid particulate material, the perforations are generally sized at a diameter of around 2-3 times less than the average particle diameter of the solid particulate material which, in a typical example, results in perforations having a diameter of no greater than 3.0 mm.

On completion of the wash cycle, rotation of the rotatably mounted cylindrical cage is ceased, and the cage is rotated in the opposite direction for a period (typically 20 minutes) at the same low rpm of the washload (40 rpm; G<1) to allow the bulk of the solid particulate cleaning material to leave the substrate to the outer wall of the cage and be collected in the storage means. The rate of collection of the solid particulate cleaning material from the substrate into the storage means is affected by the speed of rotation of said cage, with higher rotation speeds increasing the centripetal force, so as to increase the tendency to push the solid particulate cleaning material out of the substrate and onto the cage outer walls. However, higher cage rpm values also compress the substrate being cleaned, so as to trap the cleaning material within folds thereof. The most suitable rotation speeds are, therefore, generally found to be between 40 and 50 rpm for a cage of 48 cm diameter. Furthermore, it is observed that the moisture level in the wash is also significant in controlling bead egress.

The method of the invention has been shown to be particularly successful in the removal of cleaning material from the cleaned substrate after washing during tests with nylon beads comprising spherical Nylon 6,6 polymer.

Following said bead removal operation a series of rinses is typically carried out, wherein additional water is sprayed into the rotatably mounted cylindrical cage, preferably in order to effect complete removal of any additional cleaning agent employed in the cleaning operation. Most advantageously, a spray head is used, and this may be mounted in an addition port on the access door. The use of such a spray head has been shown to better distribute the rinsing water in the washload and, by this means, the overall water consumption during the rinsing operation can also be minimised (3:1 rinse water:cloth, typically, per rinse).

The cage is again rotated at low speeds during rinse water addition (30-40 rpm, G=0.49-0.88 for 98 cm diameter cage) but, after this operation has ceased, the cage speed is once again increased to achieve a measure of drying of the substrate (300-800 rpm, G=49.3-350.6). Subsequently, rotation speed is reduced and returned to the speed of the wash cycle so as to allow for final removal of any remaining solid particulate cleaning material. Said rinsing and drying cycles may be repeated as often as desired, with three repetitions being typical.

Referring now to the Figures, there is seen in FIG. 1 an apparatus according to the invention comprising housing means (1) having a first upper chamber having mounted therein a rotatably mounted cylindrical cage in the form of drum (2) (perforations not shown) and a second lower chamber comprising sump (3) located beneath said cylindrical cage. The apparatus additionally comprises water circulation means including water riser pipe (4) which feeds from the lower chamber to an entry point (5) on the top of said rotatably mounted cylindrical cage. The water circulation means is driven by a pump (6). The apparatus also comprises, for the purpose of example, a multiplicity of lifters (7) comprising storage means for solid particulate material.

Thus, FIG. 1 illustrates an embodiment of the invention wherein the solid particulate cleaning material in the form of beads is stored in the lifters (7) until rotation is imposed on the rotatably mounted cylindrical cage (2), wherein the beads are released from the lifters (7) and into the cage (2). In said embodiment, the rotatably mounted cylindrical cage comprises a drum comprising perforated side walls, wherein the perforations permit the ingress and egress of fluids and fine particulate materials of lesser diameter than the holes, but are adapted so as to prevent the egress of said solid particulate material. Consequently, said embodiment does not provide for recirculation of said solid particulate material.

Turning now to FIG. 2, there is seen an illustration of the 6 stages of the bead release cycle, wherein:

1. Beads (8) in the lifter (7) rotate within a rotatably mounted cylindrical cage, for one revolution in the direction of arrows A. In the first stage, beads (8) are located in storage compartment (9).

2. Following 90 degrees of rotation of the cylindrical cage, a proportion of beads (8) have passed though the exit port from storage volume (11) into flow path (10), by virtue of gravity acting on them relative to the lifter.

3. In stage 3, a proportion of beads (8) have entered the first side of the flow path (10), with the remaining beads stored in the storage compartment (9).

4. Following a further 90 degrees of rotation, a proportion of beads (8) has entered the second side of the flow path (10), having separated from the remaining beads stored in the storage compartment (9).

5. In stage 5, the lifter has returned to its original position, with the proportion of beads (8) now located in the final side of the flow path (10).

6. Stage 6 illustrates the proportion of beads (8) leaving the lifter via an exit port whilst the cycle begins again with another proportion of the remaining beads in storage compartment (9) passing through the exit port (11) into the flow path (10).

Thereafter, the bead collection cycle repeats the stages as previously described but in reverse.

Figure 3:
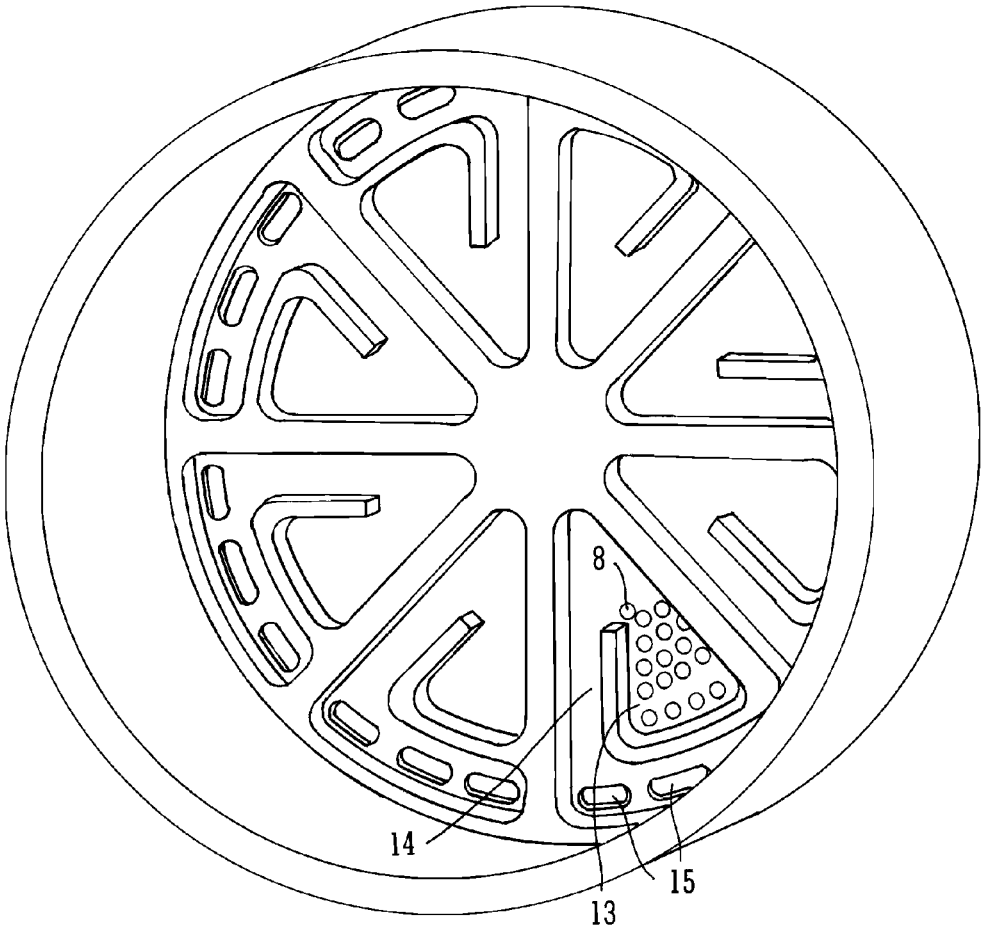
FIG. 3 illustrates a further embodiment of storage means comprised in the apparatus of the invention.

Referring now to FIG. 3, there is shown an alternative embodiment of in-drum storage means, wherein storage compartment (13) and associated flow path (14) are arranged in a circular array about the central axis of the drum, forming a disc storage means of low depth, suitable for location at the rear back face of the drum. In this particular embodiment, an array of eight storage compartments is shown. Beads (8) exit or enter the flow path via multiple ports (15) arranged around the circumference of the flow paths. The beads (8) are encouraged to collect at the perimeter of the rear of the drum by arranging the rotatably mounted cylindrical cage and housing means with a small inclination from rear to front (typically 5 degrees). The release cycle and corresponding collection cycle of the beads follows that described previously in relation to FIG. 2.

Hence, the system provides a means of adding polymeric beads or mixtures of polymeric and non-polymeric beads to a wash load, performing the washing cycle, and then separating the beads from the wash load once the washing cycle is complete. The washing process may be conveniently illustrated by describing one complete wash cycle with reference to FIGS. 1, 2 and 3.

Thus, polymeric beads or mixtures of polymeric and non-polymeric beads of the appropriate total mass to affect the desired wash performance are stored in lifters (7) having been collected during a previous cleaning cycle. A wash load is placed into the cage (2) through an openable loading door (not shown), which is subsequently closed.

Cold water, together with optional cleaning agent, is added to the system via a port in the lower chamber (3). The lower chamber (3), together with its contents (water and cleaning agent), may be heated by heating means contained within the lower chamber (3). The system temperature is monitored via a temperature probe, preferably mounted in lower chamber (3). Once the required temperature is achieved, the pump (6) pumps the water and cleaning agent up through the riser pipe (4) and cage entry (5) into the cage (2). At the same time, rotation is imposed on cage (2) to agitate the wash load and gently disperse the water and cleaning agent evenly amongst the load and fully wet out the cloth. As a consequence of this drum rotation, beads are incrementally released from the lifters (7) into the cage (2) with each revolution. Additional cleaning agents may be added with more water at later stages during the wash cycle by the same means. A typical example of such a cleaning agent is either an oxygen or chlorine based bleach. This additional additive may optionally be heated.

On completion of the wash cycle, rotation of the cage (2) is reversed and beads are collected and stored in the lifters (7).

The system then performs a wash cycle in a similar manner to a standard washing machine with the cage (2) rotating at 40 rpm (for a 48 cm cylindrical cage). The cage (2) rotates for the majority of the cycle in one direction to ensure full release of all beads, stopping on occasion to rotate a small number of rotations in the opposite direction to minimise tangling of the washload. This sequence is repeated for up to 60 minutes. During this time, the beads are continually interacting with the soiled substrate, with only a small proportion of beads collected by the lifters (7) when the direction of rotation of the cage (2) is reversed.

On completion of the wash cycle, rotation of cage (2) ceases. Following a short high speed rotation to remove some liquor from the cage and partially dry out the cleaned substrate, the direction of rotation of cage (2) is reversed at low speed to encourage the beads to fall out of the cloth to the outer walls of the cage (2), from where they are collected and stored within the lifters (7) with each drum revolution. This process is continued until virtually all of the beads have been removed from within the cage (2). At any point during these operations, air can be blown into the drum to disrupt and cause billowing of the cloth to aid bead removal. The wash load can then be removed from the cage (2) via the loading door (not shown).

In a preferred bead removal sequence, the cage (2) is rotated for 20 minutes at between 40 and 50 rpm ($G<1$), during which time the direction of rotation is reversed approximately every 3 minutes for 30 seconds in order to re-orientate the substrate and allow the beads to fall from the substrate, thereby effecting efficient bead removal.

In a separate optional step, the wash load may be rinsed with water following the wash cycle. In further optional stages, following their collection into in-drum storage means, the beads may be cleaned by filling the sump with clean water in the presence or absence of a cleaning agent, such as a surfactant, to such a level that, on rotation of the drum, lifters and beads contained therein are submerged. Alternatively, cleaning of the beads may be carried out by washing them alone in the drum following removal of the wash load.

Figure 4:
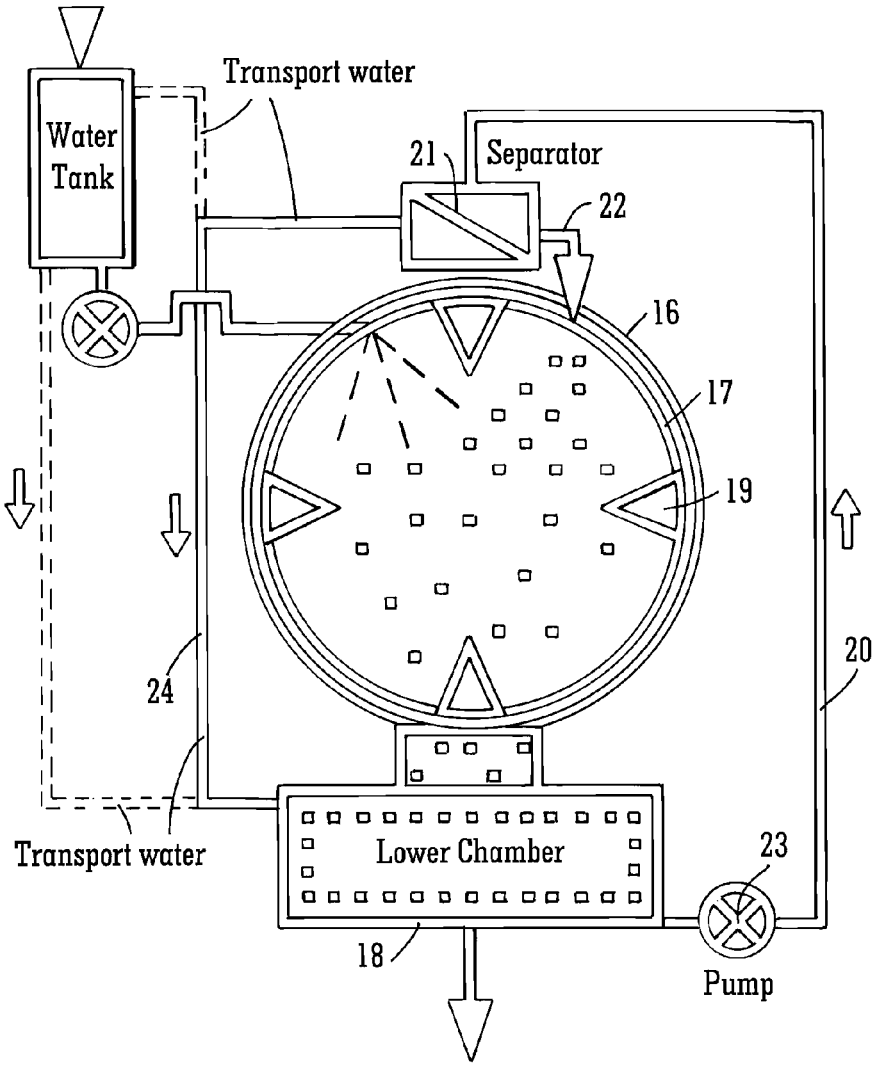
FIG. 4 shows an apparatus according to an embodiment of the invention wherein recirculation of solid particulate material is employed.

In FIG. 4, there is shown an alternative embodiment of the apparatus according to the invention, the apparatus comprising housing means having a first upper chamber (16) having mounted therein a rotatably mounted cylindrical cage in the form of drum (17) (perforations not shown) and a second lower chamber comprising sump (18) located beneath said cylindrical cage. The apparatus also comprises, for the purpose of example, a multiplicity of lifters (19) comprising storage means for solid particulate material. Furthermore, the apparatus additionally comprises, as first recirculation means, bead and water riser pipe (20) which feeds into a bead separation vessel (21), including filter material, typically in the form of a wire mesh, and a bead delivery tube (22). The first recirculation means is driven by bead pump (23). Additional recirculation means comprises return water pipe (24), which allows water to return from the bead separation vessel (21) to the sump (18) under the influence of gravity. The apparatus also comprises access means, through which material for cleaning may be loaded into the drum (17).

In said embodiment, the rotatably mounted cylindrical cage comprises a drum comprising perforated side walls, wherein the perforations permit the ingress and egress of fluids and fine particulate materials, together with solid particulate materials of lesser diameter than the holes, but are adapted so as to prevent the egress of solid particulate material comprising particles of larger diameter. Said apparatus additionally comprises recirculation means and, consequently, said embodiment provides for recirculation of said solid particulate material.

In operation according to the method of the invention, the in-drum beads storage means collection and release operation proceeds according to the method previously described in relation to FIGS. 1, 2 and 3, and this process operates in conjunction with the bead recirculation operation which is fully disclosed in connection with the operation of the apparatus disclosed in WO-A-2011/098815, incorporated herein by reference.

Figure 5:
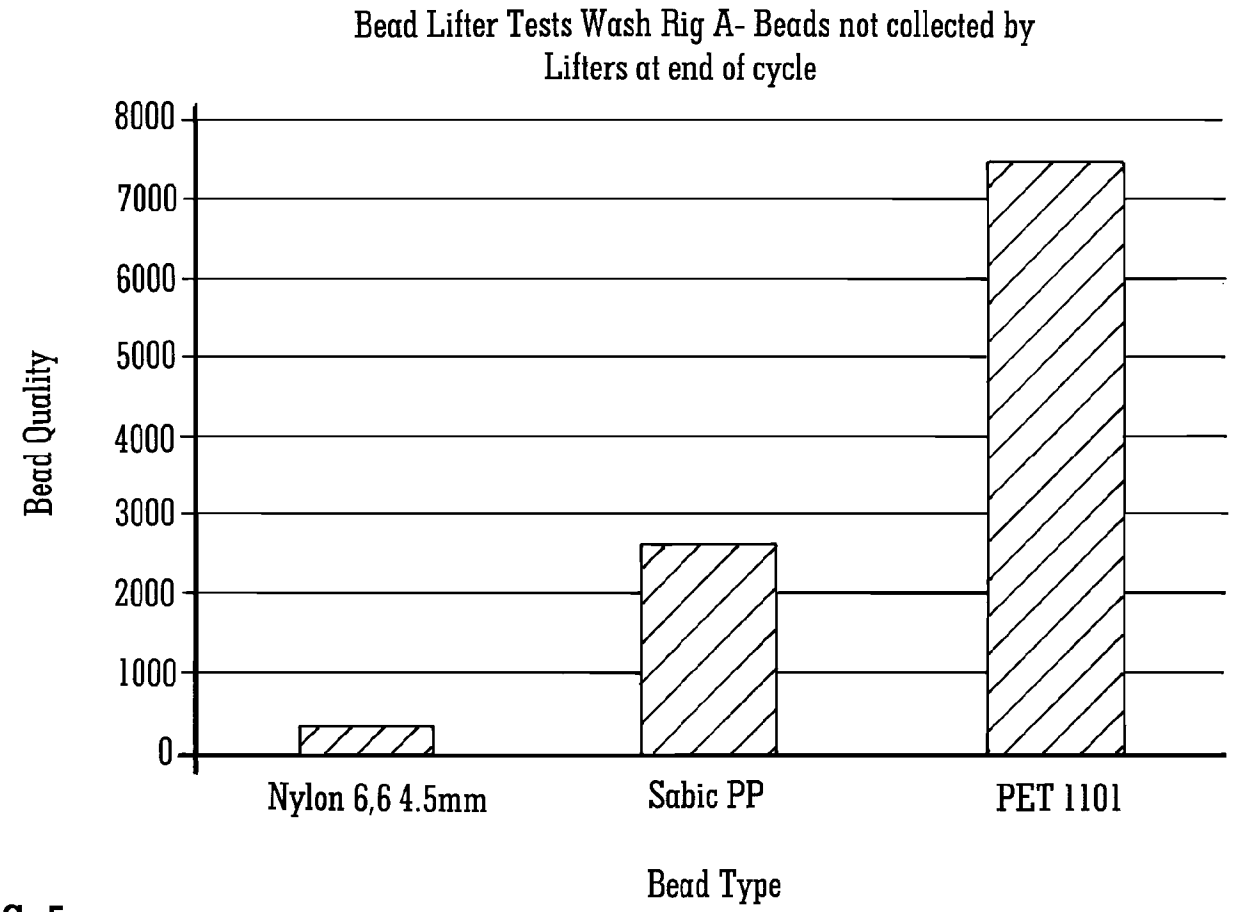
FIG. 5 shows the results of tests of the recovery rates of various solid particulate materials in storage means of an apparatus according to the invention.

Referring now to FIG. 5, there is provided a graphical representation of the results of the tests detailed below in Examples 1, 2 and 3, showing the relative efficiency of removal of collection of different bead types in the lifters of an apparatus according to the invention, from which it is observed that particularly favourable results are achieved in the case of solid particulate material which comprises Nylon 6,6.

Figure 6:
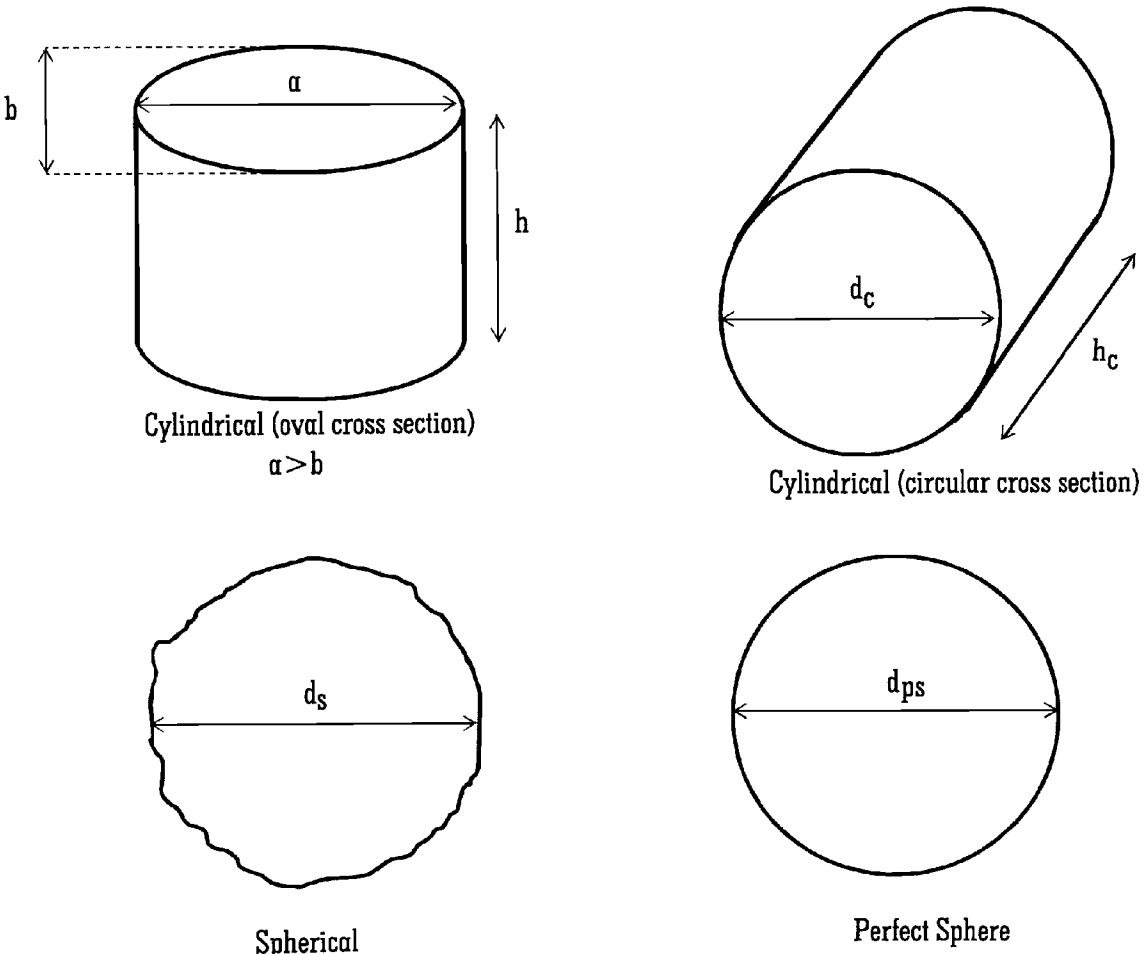
FIG. 6 is a diagrammatic representation of particles which are employed in the method of the invention.

Turning finally to FIG. 6, there is provided a diagrammatic representation of different cylindrical and spherical particles which may be utilised in the method of the invention.

The operation of the apparatus and method of the invention, and the efficacy of the collection and storage of solid particulate cleaning material during said method, will now be further illustrated, though without in any way limiting the scope of the invention, by reference to the following examples.

EXAMPLES

Example 1

Cylindrical dry beads (average dimensions: long axis diameter 4.22 mm, short axis diameter 3.5 mm, height 3.97 mm) of SABIC® PP (polypropylene) grade 575P were added to the drum of a washing machine according to the invention which incorporated storage compartments in the lifters on the inner surface of the drum. The drum was rotated in clockwise rotation until no further beads were collected by the lifters. Surplus beads in the drum were removed, and the drum was then rotated in an anti-clockwise direction until all the beads had been emptied from the lifters. The beads released in this manner from the lifters were then collected by vacuum and weighed, and the bulk volume was defined.

A wash load was rinsed and spun in a BEKO® domestic washing machine (Model WM5120W), then weighed to check its water content. Beads were then mixed with the damp wash load in a large container, and the wash load and beads were loaded into the drum of the apparatus of the invention, which was then operated for an 11 minute cycle which comprised a 3 minute clockwise cycle, a 1 minute anti-clockwise cycle, a further 3 minute clockwise cycle, a 1 minute anti-clockwise cycle and a final 3 minute clockwise cycle. The wash load was then removed from the drum and the beads were separated from the cloth and added to the beads sitting in the drum. All beads where then weighed.

Finally, the empty drum was run on an anti-clockwise cycle to empty the lifters of beads, and these beads were then vacuumed up and weighed.

The results of the experiment were as shown below:

| | |
|---|---|
| Mass of Dry Wash Load | 3 kg |
| Mass of Wash Load after Rinse and Spin | 4.52 kg |
| Bead Mass | 3 kg |
| Bead Volume | 5.3 L |
| Bead Mass in Clothes/Drum after Cycle | 0.08 kg |
| Bead Mass recovered from Lifters after Cycle | 2.89 kg |
| Bead Mass trapped underneath Lifters | 0.03 kg |
| % Beads captured in Lifters during Cycle | 96.3% |
| Mass of Beads not captured by Lifters | 0.08 kg |
| Number of Beads per kg | 32849 |
| Number of Beads not captured by Lifters | 2628 |

Example 2

The procedure of Example 1 was repeated using spherical Nylon 6,6 beads of diameter 4.5 mm (as supplied by Hoover® Precision Products), and the following results were observed:

| | |
|---|---|
| Mass of Dry Wash Load | 3 kg |
| Mass of Wash Load after Rinse and Spin | 4.57 kg |
| Bead Mass | 3.6 kg |
| Bead Volume | 5.3 L |
| Bead Mass in Clothes/Drum after Cycle | 0.02 kg |
| Bead Mass recovered from Lifters after Cycle | 3.58 kg |
| Bead Mass trapped underneath Lifters | 0 kg |
| % Beads captured in Lifters during Cycle | 99.4% |
| Mass of Beads not captured by Lifters | 0.02 kg |
| Number of Beads per kg | 18140 |
| Number of Beads not captured by Lifters | 363 |

Example 3

The procedure of Example 1 was repeated using cylindrical PET 1101 beads (average dimensions: long axis diameter 3.01 mm, short axis diameter 2.23 mm, height 2.11 mm—as supplied by INVISTA® Polymer & Resins) and the following results were observed:

| | |
|---|---|
| Mass of Dry Wash Load | 3.08 kg |
| Mass of Wash Load after Rinse and Spin | 4.65 kg |
| Bead Mass | 4.86 kg |
| Bead Volume | 5.3 L |
| Bead Mass in Clothes/Drum after Cycle | 0.097 kg |
| Bead Mass recovered from Lifters after Cycle | 4.67 kg |
| Bead Mass trapped underneath Lifters | 0 kg |
| % Beads captured in Lifters during Cycle | 96.1% |
| Mass of Beads not captured by Lifters | 0.12 kg |
| Number of Beads per kg | 63261 |
| Number of Beads not captured by Lifters | 7465 |

It is apparent from these studies that the apparatus and method of the present invention provides for very high efficiency of both removal of the beads from the washload and collection of these beads in the storage compartments of the lifters Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An apparatus for use in the treatment of substrates using a solid particulate material, said apparatus comprising:

(a) housing means having mounted therein a rotatably mounted cylindrical cage;

(b) access means; and (c) a multiplicity of delivery means, wherein said rotatably mounted cylindrical cage additionally comprises at least one storage compartment for storage of said solid particulate material, wherein said at least one storage compartment comprises a storage volume, a flow path, a first exit port from the storage volume into said flow path, and a second exit port from the flow path into the interior of the rotatably mounted cylindrical cage, wherein said flow path between the first and second exit ports defines a non-linear trajectory, wherein said flow path allows transport of fluids and solid particulate material between said storage volume and the inside of said rotatably mounted cylindrical cage, and wherein ingress or egress of fluids and solid particulate material into and out of said at least one storage compartment via said flow path is controlled by the direction of rotation of said rotatably mounted cylindrical cage, and the ingress or egress is dependent on said direction of rotation.

2. An apparatus as claimed in claim 1 wherein said rotatably mounted cylindrical cage comprises a plurality of storage compartments.

3. An apparatus as claimed in claim 1 wherein said at least one storage compartment is located on at least one inner surface of said rotatably mounted cylindrical cage.

4. An apparatus as claimed in claim 1 wherein said rotatably mounted cylindrical cage comprises a plurality of storage compartments located at equidistant intervals on the inner circumferential surface of said rotatably mounted cylindrical cage.

5. An apparatus as claimed in claim 1 wherein said at least one storage compartment is located on the inner end surface of said rotatably mounted cylindrical cage.

6. An apparatus as claimed in claim 1 wherein said rotatably mounted cylindrical cage comprises a plurality of storage compartments, wherein said storage compartments are comprised in spaced apart lifters affixed to the inner surface of said rotatably mounted cylindrical cage.

7. An apparatus as claimed in claim 1 wherein said rotatably mounted cylindrical cage comprises a drum comprising solid side walls with no perforations.

8. An apparatus as claimed in claim 1 where said rotatably mounted cylindrical cage is located within a first upper chamber of said housing means and said apparatus additionally comprises a second lower chamber which comprises a sump.

9. An apparatus as claimed in in claim 8 wherein said rotatably mounted cylindrical cage comprises a drum comprising perforated side walls with perforations having a diameter no greater than 5.0 mm.

10. A method for treating a substrate, said method comprising the treatment of the substrate with a formulation comprising solid particulate material, wherein said method is carried out in an apparatus as claimed in claim 1.

11. A method as claimed in claim 10, said method comprising cleaning at least one substrate which comprises at least one soiled substrate.

12. A method as claimed in claim 11 wherein said at least one soiled substrate comprises at least one textile fibre garment.

13. An apparatus as claimed in in claim 8 wherein said rotatably mounted cylindrical cage comprises perforated side walls in which the perforations comprise holes having a diameter less than that of the particles of said solid particulate material.

14. A method as claimed in claim 10 wherein said rotatably mounted cylindrical cage is located within a first upper chamber of the housing means of said apparatus, and beneath said first upper chamber is located a second lower chamber, said apparatus having a recirculating means, wherein said method comprises the steps of:

(a) introducing water into the second lower chamber of said apparatus;

(b) heating said water;

(c) loading at least one soiled substrate into said rotatably mounted cylindrical cage via access means;

(d) closing the access means so as to provide a substantially sealed system;

(e) introducing said water into said rotatably mounted cylindrical cage via recirculating means;

(f) operating the apparatus for a wash cycle, wherein said rotatably mounted cylindrical cage is caused to rotate and said solid particulate cleaning material is caused to dispense from said at least one storage compartment in a manner controlled by said rotation of said cage; and (g) continuing with step (f) as required to effect cleaning of the soiled substrate.

15. A method as claimed in claim 14 wherein, on completion of the wash cycle, rotation of said rotatably mounted cylindrical cage is caused to occur at a G force of less than 1 so as to allow for removal of said solid particulate cleaning material to said at least one storage compartment..

16. A method as claimed in claim 10, said method comprising drying at least one wet substrate.

17. A method as claimed in claim 16 wherein said at least one wet substrate comprises at least one textile fibre garment.

18. A method as claimed in claim 10 wherein the ratio of solid particulate material to substrate is in the range of from 0.1:1 to 10:1 w/w.

19. A method as claimed in claim 10 wherein the wash cycle is performed at temperatures of between 5 and 95° C. for a duration of between 5 and 120 minutes.

* * * * *